US012312891B2

(12) United States Patent
Maribu et al.

(10) Patent No.: US 12,312,891 B2
(45) Date of Patent: May 27, 2025

(54) METHOD AND APPARATUS FOR MILLING A WINDOW IN CASING

(71) Applicant: CONOCOPHILLIPS COMPANY, Houston, TX (US)

(72) Inventors: Kenneth Maribu, Tananger (NO); John Gary Eller, Longview, TX (US); Anthony Ryan, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 18/650,829

(22) Filed: Apr. 30, 2024

(65) Prior Publication Data

US 2024/0352819 A1 Oct. 24, 2024

Related U.S. Application Data

(63) Continuation of application No. 17/457,341, filed on Dec. 2, 2021, now Pat. No. 12,000,226.

(Continued)

(51) Int. Cl.

| | |
|---|---|
| ***E21B 29/06*** | (2006.01) |
| ***E21B 29/04*** | (2006.01) |
| ***E21B 29/12*** | (2006.01) |

(52) U.S. Cl.

CPC ..... *E21B 29/06* (2013.01); *E21B 29/04* (2013.01); *E21B 29/12* (2013.01)

(58) Field of Classification Search

CPC ..... E21B 29/06; E21B 29/005; E21B 29/08; E21B 29/04; E21B 29/12

See application file for complete search history.

(56) References Cited

U.S. PATENT DOCUMENTS 5,887,655 A * 3/1999 Haugen ..... E21B 7/061 175/425
6,135,215 A * 10/2000 Ericksen ..... E21B 17/20 175/90

(Continued)

FOREIGN PATENT DOCUMENTS

EP 3680447 A1 7/2020
WO WO-9964715 A1 * 12/1999 ..... E21B 27/02

OTHER PUBLICATIONS

International Search Report for PCT/US2021/072699 mailed May 6, 2022; 4 pgs.

(Continued)

*Primary Examiner* — Yanick A Akaragwe

(74) *Attorney, Agent, or Firm* — CONOCOPHILLIPS COMPANY

(57) ABSTRACT

A process is described for milling a window in the casing (2) of an oil or gas producing well, for example in order to drill a lateral well branching off from the main well. A wireline milling tool is first used, in a relatively low cost operation, to create a small window (14) or notch in the casing (2). Provided a small window (14) or notch can be created successfully, an expensive heavy duty coil tubing milling operation can then be conducted to create the full window, some 4-6 feet in length. Previous attempts to create a full window using wireline tools have encountered difficulties due to there being no circulating drilling fluid to remove metal swarf and due to the need for the tool to be supported by casing during the milling operation, when the integrity of the casing is being compromised by drilling the window. The proposed wireline tool has an actuator (4) with relatively small stroke length and a relatively small container (8) to manage the swarf produced by the milling process.

8 Claims, 2 Drawing Sheets

Related U.S. Application Data

(60) Provisional application No. 63/120,612, filed on Dec. 2, 2020.

(56) References Cited

U.S. PATENT DOCUMENTS

| | | | | |
|---|---|---|---|---|
| 6,612,383 | B2 | 9/2003 | Desai et al. | |
| 8,464,794 | B2 * | 6/2013 | Schultz | E21B 43/11 166/250.1 |
| 2006/0231258 | A1 * | 10/2006 | Head | E21B 29/06 166/384 |
| 2008/0066913 | A1 * | 3/2008 | Lynde | E21B 29/005 166/55.3 |
| 2008/0092356 | A1 * | 4/2008 | Fuhst | B23D 21/14 409/143 |
| 2012/0318509 | A1 * | 12/2012 | Fuhst | E21B 23/01 166/55.7 |
| 2015/0021029 | A1 * | 1/2015 | Abrant | E21B 29/08 166/298 |
| 2017/0198538 | A1 | 7/2017 | Hansen et al. | |

OTHER PUBLICATIONS

Vestavik, O.M.—"Casing window milling with abrasive fluid jet", 1995, SPE 30453, Abstract, pp. 45-49; 5 pgs.

* cited by examiner

METHOD AND APPARATUS FOR MILLING A WINDOW IN CASING

CROSS-REFERENCE TO RELATED APPLICATIONS

This application is a continuation application which claims benefit under 35 USC § 120 to U.S. application Ser. No. 17/457,341 filed Dec. 2, 2021, entitled "METHOD AND APPARATUS FOR MILLING A WINDOW IN CASING," which is a non-provisional application which claims benefit under 35 USC § 119 (e) to U.S. Provisional Application Ser. No. 63/120,612 filed Dec. 2, 2020, entitled "METHOD AND APPARATUS FOR MILLING A WINDOW IN CASING," which is incorporated herein in its entirety.

FEDERALLY SPONSORED RESEARCH AND DEVELOPMENT

None.

FIELD OF THE INVENTION

This invention relates to the milling of a window in the casing of an oil or gas well, for example in order to allow for drilling a sidetrack well.

BACKGROUND OF THE INVENTION

Prior to sidetracking a well, a window is cut into the existing casing to create a point of departure. For thru-tubing drilling, the process of milling the window is normally carried out using a milling tool run into the well on coil tubing through the existing production tubing. The milling operation can be difficult and the process is not always successful.

For offshore operations, coiled tubing operations are normally performed using a drilling rig and may involve a lead time of ten or more days to mobilize the equipment for the operation. High grade casing may be employed, e.g. Q-125 grade casing commonly used in the Greater Ekofisk Area (GEA) of the North Sea, which can make the milling process harder and success less predictable.

Jointed drill pipe may also be used to run a milling tube into a wellbore and conduct a milling operation.

Milling operations using a milling tool run into hole on wireline have been attempted. Wireline is considerably cheaper and less time consuming to mobilize than coiled tubing, since it does not require a drilling rig. There are, therefore, good reasons for doing this.

However, for a wireline operation the tooling requires apparatus to grip the casing in order to have the support to apply the necessary forces to the tubing/casing to mill it. A mechanism must be provided to advance the milling tool relative to the gripping apparatus—an operation known as stroking. Since the casing supporting the gripping apparatus and milling tool is itself being milled away in the process, this presents challenges. For example, the stroking length may need to be very long so that the tool can be secured in an un-damaged region of casing and still be able to mill out the required length of window—normally 4 to 6 feet. Another problem is debris management, since drilling fluid cannot be circulated when using wireline, whereas when using coil tubing or drill pipe, fluid may be circulated to remove swarf from the milling.

There have been some previous efforts made to mill casing exits with wireline tools but there is no viable system available of which the inventors are aware.

BRIEF SUMMARY OF THE DISCLOSURE

The inventors have appreciated that it is the initial phase of a coiled tubing (or drill pipe) milling operation which is often the most difficult, in general terms. This is particularly the case for offshore operations and where the Q-125 grade casing is present. However, once a small ledge or a "notch" or small window in the tubing/casing has been successfully established, the remainder of the job could be expected to proceed smoothly.

The inventors therefore have therefore conceived of a two stage process in which a wireline milling operation is carried out in order to establish a ledge or notch in the casing; then, provided that task is successfully carried out, a rig can be brought in to finish the milling job using coiled tubing or jointed drill pipe.

The advantages of this two stage process are that the initial, risky phase of the operation can be done without the expense of committing to deploying a drilling rig and associated equipment for a coil tubing or drill pipe based operation. Only when it is apparent that the job is likely to succeed is it necessary to commit to this cost. If the wireline milling tool is only required to cut a ledge, or notch (relatively small aperture) in the casing, then the stroking length need not be as long as if a full 4 to 6 feet window is to be milled. Furthermore, the strength of the tubing/casing is not significantly impaired by milling a small notch or window, so the tubing/casing providing sufficient support for the milling process becomes less of a problem. Furthermore, since only a relatively small quantity of milled away material is produced, the problem of dealing with this material without being able to circulate fluid is greatly reduced.

The invention more particularly includes a method of milling a window in the casing of an oil or gas well, the method comprising:

(a) Running a first milling tool into the well to a milling site using wireline, the first milling tool including a facility to grip the casing;
(b) Gripping the casing with the milling tool, milling away a portion of the material of the casing at the milling site and then withdrawing the milling tool;
(c) Running a second milling tool into the well to the milling site, using coiled tubing or drill pipe;
(d) Using the second milling tool, milling away further material from the casing at the milling site until a window of a required dimension has been milled through the casing.

In another aspect, the invention provides a wireline milling tool comprising:

(a) A tool body including a mechanism for gripping casing to anchor the tool;
(b) A milling head and a rotary drive;
(c) An actuator arm for transmitting drive to the milling head, the actuator arm being selectively extendable by maximum of 24 inches, such as between 6 inches and 24 inches.

Optional features of the invention are set out in the dependent claims of the appended claim set.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

BRIEF DESCRIPTION OF DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
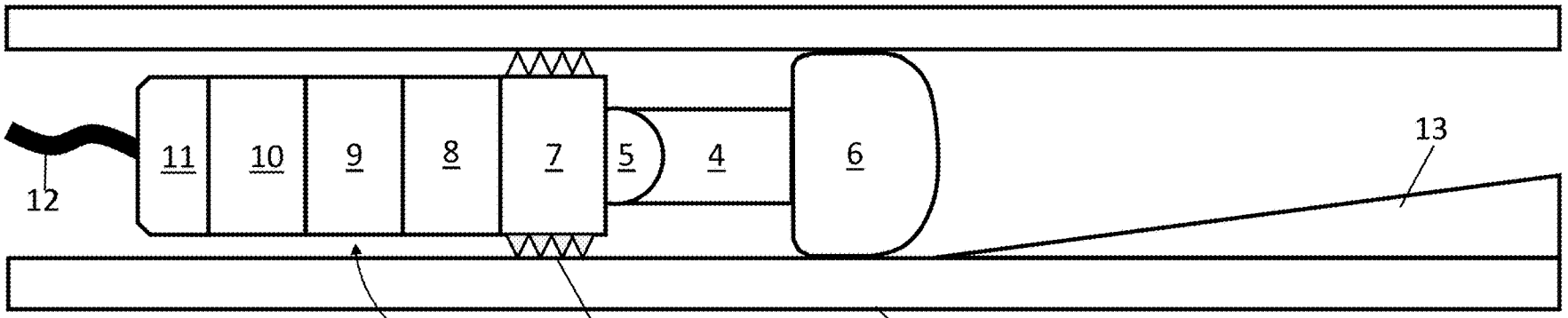
FIG. 1 is a schematic view of a wireline milling tool in situ in a casing, with a whipstock in place.

FIG. 1 shows a milling tool in accordance with the invention. The drawing is not to scale, and the aspect ratios of the various components may have been shown incorrectly for the sake of clarity. The terms "proximal" and "distal" are used to describe the location of features of the tool, and these terms are used with respect to the entrance to the well, i.e. the surface.

The tool comprises a tool body 1 which is shown anchored in casing 2 by means of retractable gripping elements 3. At the distal end of the tool is an actuator arm 4 mounted to the tool body 1 via a linkage, represented generally at 5, which allows the arm to be angled. At the distal end of the actuator arm is a milling head 6 which rotates with the arm 4. Within the tool body and the actuator arm is an internal shaft (not shown) which rotates the milling head 6. The details of the actuator arm 4, including telescopic construction allowing it and the drive shaft to extend whilst rotating the milling head are omitted for clarity, as are the hydraulic actuators internal to the arm. However, the general construction of these features would be well known one of ordinary skill in this field. Unlike coil tubing milling tools, the milling head 6 and arm 4 are designed such that cut swarf is fed back through the arm 4 and collected within the tool body 1.

In the tool body 1 are located a mechanism 7 for engaging and disengaging the gripping elements 3, a collection area 8 for cuttings, a CPU 9 for controlling the functioning of the various elements of the tool, a power unit 10 including an electrically powered hydraulic pump (not shown) for supplying hydraulics to drive some of the tool elements (not shown), and a cable head 11 for connecting with a cable 12 on which the tool is run into the well and which supplies it with electrical power.

The milling tool is unusual in that the capacity of the actuator arm to move the milling head along the casing is very small in comparison to known coil tubing milling tools and also in comparison to previous unsuccessful designs for wireline milling tools. The maximum stroke length is in this example 24 inches. This would normally be sufficient to mill a small window in the casing with a length of about 18 inches. Depending upon the tool design, stroke length may vary from approximately 5, 6, 7, 8, 9, 10, 11, 12, 13, 14, 15, 16, 17, 18, 19, 20, 21, 22, 23, up to 24 inches or more. Given different stroke lengths, the small window may also vary from 2, 3, 4, 5, 6, 7, 8, 9, 10, 11, 12, 13, 14, 15, 16, 17, to 18 inches or more. Alternatively, the tool may simply mill a notch or cutaway extending a substantial distance through the casing but not actually penetrating the full thickness of the casing.

The collection area 8 for cuttings is relatively small compared with previous attempted designs for wireline milling tools, since the tool is designed to mill away only a relatively small amount of metal. In this example, which is designed for milling a window in 5 inch casing, the collection region has a total volume of 50 $in^3$. Depending upon the casing size and window length, different volumes of cuttings may be generated from approximately 10, 15, 20, 25, 30, 35, 40, 45, 50, 55, 60, 65, 70, 75, 80, 85, 90, 95, or 100 $in^3$ of casing steel, or more. If larger casing is to be catered for, a larger capacity would likely be necessary.

A whipstock tray 13 is shown in the casing distal of the milling tool.

Figure 2:
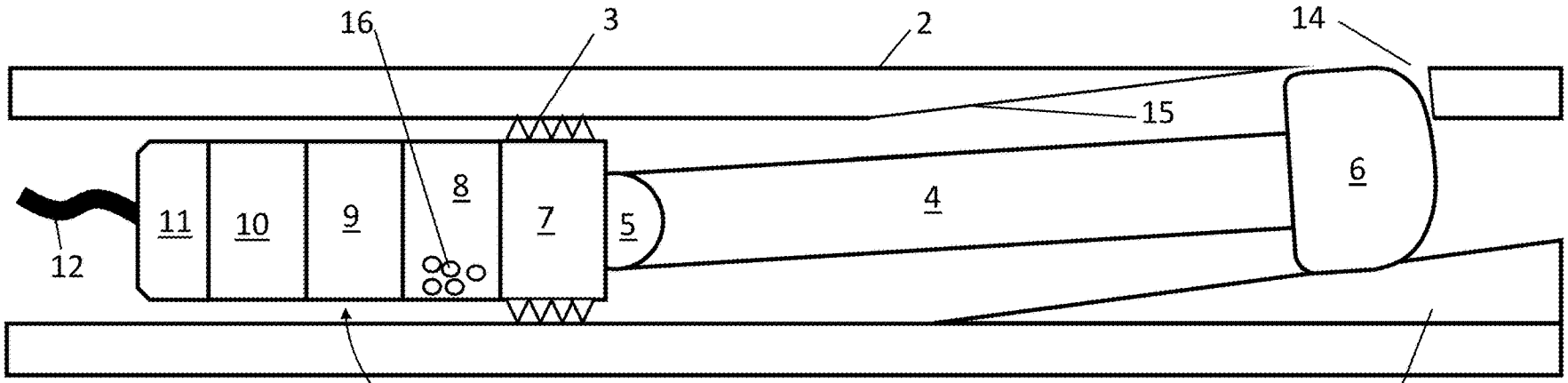
FIG. 2 is a view similar to FIG. 1 showing the tool in the process of milling a small window in the casing.

FIG. 2 shows the same tool with its actuator arm 4 in its fully extended state and having milled an inclined cutaway portion 15 of the casing 2 ending in a small window 14 in the casing 2. Cuttings 16 are shown in the collection area 8.

Stroker tools and milling heads are, of course, both currently available technology. With some development, it may be possible create a suitable tool by adapting an existing high force stroker tool in combination with a rotational device for cutting the window.

The operation of milling a casing window using the wireline milling tool will now be described.

The operation would normally be performed through existing production tubing, although this is not essential. A whipstock is first run through the production tubing and out of the end of the tubing. Alternatively, it may be possible to set a whipstock within the tubing and mill a window through tubing and casing. The whipstock comprises a packer or other anchor, with a shallow inclined tray portion made of a hard material. This is shown at 13 in FIGS. 1 and 2. The purpose of the whipstock is to divert the direction of the milling head and to help provide the necessary reaction force to allow it to bear against the casing 2 opposite the whipstock tray 13; the material of the whipstock tray being chosen such that it is not itself milled away to a substantial degree.

The milling tool is then run into the tubing on wireline. The tool may free fall into the tubing or, if the well is substantially deviated from vertical, it may be pumped down. Unlike delivery using coil tubing or drill string, the surface equipment needed for this operation is not substantial, and the operation could be performed from a production platform or from a vessel. It is not necessary to employ a costly drilling rig.

Wireline includes an electric power cable which, directly or indirectly, powers the various functions of the milling tool.

Once the milling tool has passed along the tubing to the region of the well where a casing window is required the gripping elements 3 are extended by means of an actuating mechanism 7 whose details are not shown but are conventional. The mechanism is powered hydraulically from the power unit 10, which includes an electric hydraulic pump powered from the wireline supply.

The tool can be installed in the casing relatively near to the point where the casing window is to be started (e.g. adjacent the proximal end of the whipstock or whipstock tray), since it is only intended at this stage to mill away a small amount of the casing. The casing will therefore retain most of its strength, even very near the portion to be milled. The tool may be installed, for example, 6 inches from the start (proximal end) of the window to be milled.

Once installed in position, the milling head is rotated by a drive shaft and linkages (not shown) extending from an electric motor (not shown) in the power unit 10 and through the tool body 1 and the actuator arm 4.

A hydraulic mechanism (not shown) in the actuator arm 4 then extends the arm 4 distally of the tool body 4. The drive shaft (not shown) includes a telescopically extendable portion which allows it to extend whilst continuing to rotate the milling head 6. If all goes well, as the milling head 6 advances the whipstock tray 13 forces it into engagement with the casing wall and the steel of the casing 2 is milled away. The forces involved are considerable, for example as much as 3,000 lbs force, making this a challenging operation.

The linkage 5, as well as linkages (not shown) in the drive shaft, allow the angle of the actuator arm 4 with the axis of the casing to change to accommodate the milling head 6 progressing along the whipstock tray 13.

The arm is extended a total of 24 inches to mill a small window in the casing with a length of about 18 inches. Once this is achieved, the actuator arm 4 and the gripping elements 3 are retracted. The tool is then withdrawn.

Figure 3:
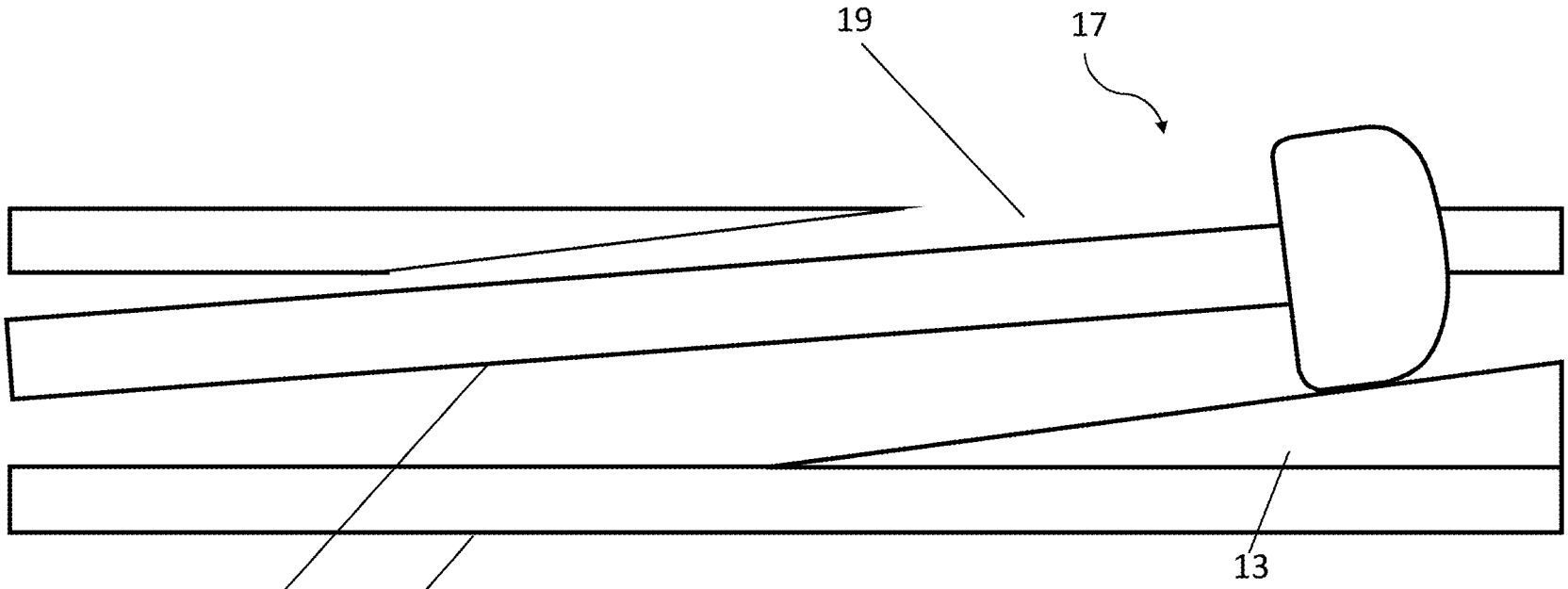
FIG. 3 is a view similar to FIG. 1 showing a second milling tool.

Provided this operation has been performed successfully, a drilling rig, e.g. with coil tubing equipment, may then be brought up and a conventional milling tool 17 (see FIG. 3) deployed using coil tubing or drill pipe, either being represented in FIG. 3 by numeral 18, to mill the full size 4-6 feet window 19. The fact that a small window has already been created considerably increases the chances for a successful milling operation with the coil tubing tool. When running the milling tool on coil tubing or drill pipe, fluid may be circulated in a conventional way to remove the swarf from the milling process and bring it up to the surface. The milling tool run on coil tubing or drill pipe is not shown in the drawings, since such devices are well known.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow. At the same time, each and every claim below is hereby incorporated into this detailed description or specification as an additional embodiments of the present invention.

The invention claimed is:

1. A wireline milling tool comprising:

a tool body including a mechanism for gripping casing to anchor the tool;

a milling head and a rotary drive;

an actuator arm for transmitting drive to the milling head, the actuator arm being selectively extendable;

a container for collecting swarf milled away by the tool, the container being located in the tool body, proximally of the actuator arm.

2. The wireline milling tool according to claim 1, wherein said container has a volume of approximately 10, 15, 20, 25, 30, 35, 40, 45, 50, 55, 60, 65, 70, 75, 80, 85, 90, 95, or 100 $in^3$.

3. The wireline milling tool according to claim 1, wherein said actuator arm extends from approximately 5, 6, 7, 8, 9, 10, 11, 12, 13, 14, 15, 16, 17, 18, 19, 20, 21, 22, 23, or 24 inches.

4. A method of milling a window in the casing of an oil or gas well, the method comprising:

running the wireline milling tool of claim 1 into the well to a milling site using wireline, the wireline milling tool including a facility to grip the casing;

gripping the casing with the wireline milling tool gripping facility, milling away a portion of the material of the casing at the milling site and then withdrawing the wireline milling tool;

running a second milling tool into the well to the milling site, using coiled tubing or jointed drill pipe;

using the second milling tool, milling away further material from the casing at the milling site until a window of a required dimension has been milled through the casing.

5. The method according to claim 4, wherein a whipstock is run into the well prior to running in the wireline milling tool, and the wireline milling tool is run in to a location adjacent the whipstock.

6. The method according to claim 4, wherein the full thickness of the casing is not penetrated by the wireline milling tool or the wireline milling tool mills a window in the casing having a length selected from 2, 3, 4, 5, 6, 7, 8, 9, 10, 11, 12, 13, 14, 15, 16, 17, or 18 inches.

7. The method according to claim 4, wherein the wireline milling tool mills away approximately 10, 15, 20, 25, 30, 35, 40, 45, 50, 55, 60, 65, 70, 75, 80, 85, 90, 95, or 100 $in_3$ of casing steel.

8. The method according to claim 4, wherein fluid is circulated during milling to remove milled swarf.

* * * * *